US005502772A

United States Patent [19]

Felder

[11] Patent Number: 5,502,772

[45] Date of Patent: Mar. 26, 1996

[54] SPEAKER HAVING IMPROVED SOUND SQUARE, SOUND BANK, SOUND ANGLE, SOUND WEDGE AND SOUND RADIATORS

[76] Inventor: Charles J. Felder, 2440 E. Tudor Rd. #997, Anchorage, Ak. 99507

[21] Appl. No.: 276,478

[22] Filed: Jul. 18, 1994

[51] Int. Cl.[6] ..... H04R 25/00

[52] U.S. Cl. ..... 381/188; 381/205; 381/87; 381/88; 381/24; 381/90; 181/199

[58] Field of Search ..... 381/188, 205, 381/87, 88, 90, 89, 24; 181/144, 145, 148, 155, 156, 198, 199

[56] References Cited

U.S. PATENT DOCUMENTS

| | | | |
|---|---|---|---|
| 3,582,553 | 6/1971 | Bose | 381/89 |
| 4,037,051 | 7/1977 | Fuselier | 381/90 |
| 4,179,585 | 12/1979 | Herrenschmidt | 381/188 |
| 4,224,469 | 9/1980 | Karson | 381/188 |
| 4,764,960 | 8/1988 | Aoki | 381/188 |
| 4,805,221 | 2/1989 | Quaas | 381/188 |
| 5,147,986 | 9/1992 | Cockrum | 181/145 |
| 5,170,436 | 12/1992 | Powell | 381/188 |

*Primary Examiner*—Curtis Kuntz
*Assistant Examiner*—Minsun Oh
*Attorney, Agent, or Firm*—Michael I. Kroll

[57] ABSTRACT

A multi-dimensional speaker system having a specifically configured arrangement comprising, tweeters, mid-range, sub-woofer, woofer, air baffles and spacers to enhance sound reproduction.

6 Claims, 3 Drawing Sheets

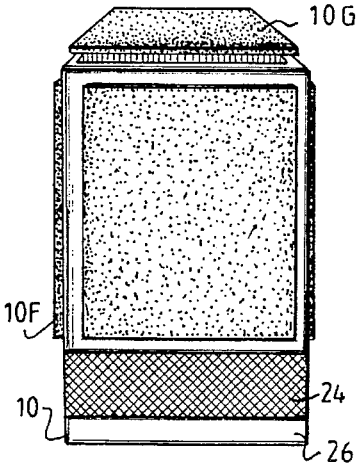
Fig. 5A
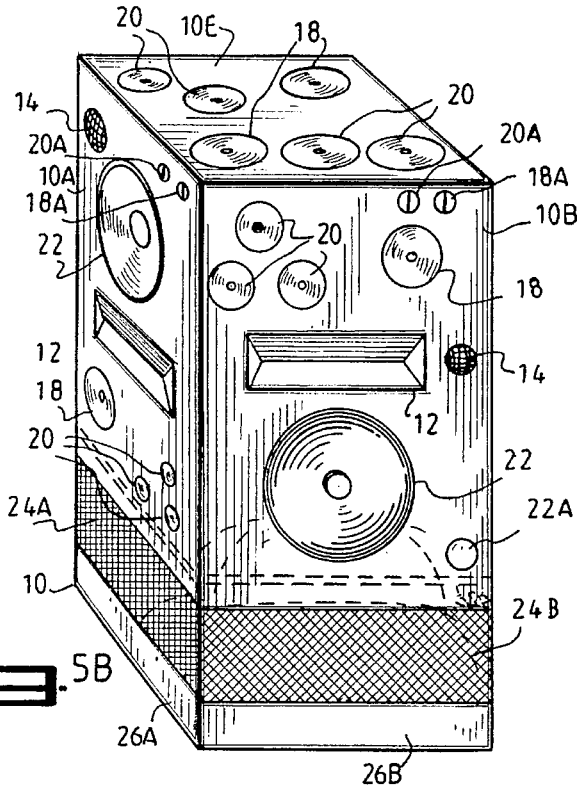
Fig. 5B
Fig. 6
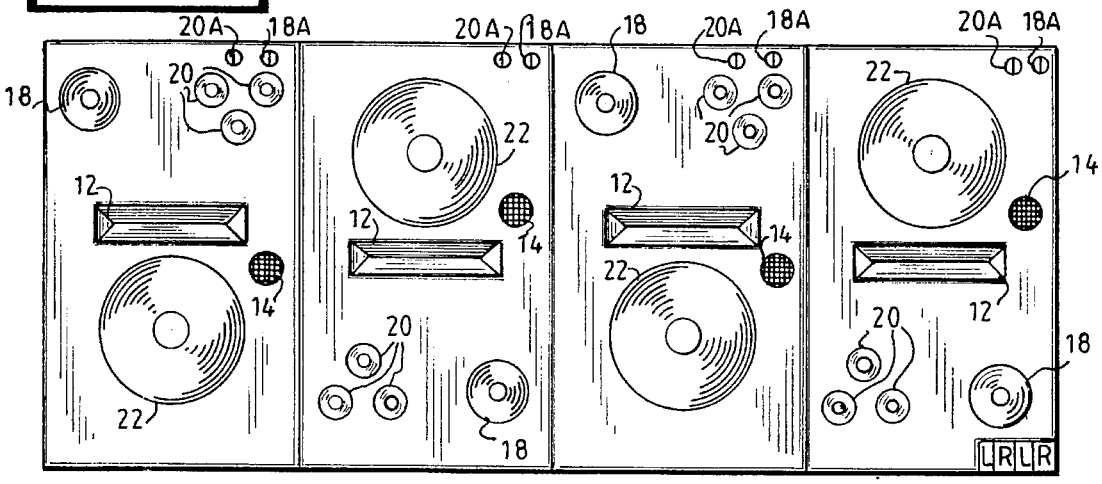
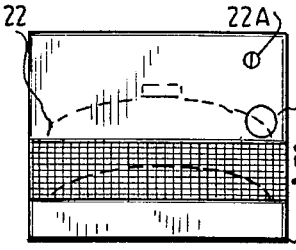
Fig. 7
Fig. 8
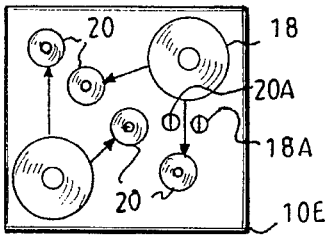

SPEAKER HAVING IMPROVED SOUND SQUARE, SOUND BANK, SOUND ANGLE, SOUND WEDGE AND SOUND RADIATORS

BACKGROUND OF THE INVENTION

1. Field of the Invention:

The present invention relates to improvements in ducting for acoustical speakers and enclosures.

The invention relates generally to loudspeaker enclosures utilized for sound reproduction and particularly to a method and apparatus for more fully utilizing existing driver cone radiated energy for improvement of efficiency and quality of sound.

This invention relates, generally, to speaker cabinets, and more particularly relates to speaker cabinets of the type having more than one speaker positioned therein and being provided with means that allow the sounds emanating from the speakers to mix prior to discharge of the sound by a horn member.

2. Description of the Prior Art:

A bass loudspeaker, or woofer, radiates sound both in the forward and rearward directions. One of the purposes of a speaker enclosure is to prevent the cancellation effect of the rear wave of the woofer upon the waves radiated from the front by isolating the forward wave from the rearward wave. Several kinds of enclosures are known in the art:

(a) Infinite Baffle (Air Suspension): An air suspension enclosure is a completely sealed box in which the rear wave is prevented from cancelling the front wave;

(b) bass Reflex: The bass reflex design utilizes a portion of the rear wave of the woofer to augment the front wave;

(c) horn Enclosure: In this design, a horn acts as an acoustical transformer that matches the high mechanical impedance of the vibrating diaphragm to the relatively low acoustical impedance of the air at the large mouth of the horn; and (d) acoustical Labyrinth: This design channels the rear wave from the woofer through a folded passageway so that when the sound finally emerges it is delayed as much as possible and, therefore, reinforces the woofer at the lowest possible frequency.

The use of quality sound systems in both the home and in businesses are often times limited by the size limitations on the speaker enclosures and hence, there has been considerable effort to achieve big sound while utilizing a small enclosure. Various types of ducting has been accomplished in connection with the speaker enclosures in an attempt to effectively extend the frequency response curve at the low end.

Since low frequency response is largely dependent on the loud speaker system resonance, current designs usually rely on an enclosure that is proportionally large in relation to the driver. Stated another way, the larger the enclosure, the lower the frequency resonance. The driver, or any other moving piston in connecting with the enclosure represents an enclosure opening. The smaller the enclosure opening is, again the lower the resonance is. Therefore, reducing the enclosure size means reducing the driver size as well if low frequency performance is to be maintained.

However, in the case of small enclosures, the driver size must be too small to be an efficient radiator if low frequency performance is the objective. Also, power handling ability is decreased with the use of small drivers. Therefore, it is a practice of most small loud speaker system designs to use a larger driver in order to keep efficiency reasonable, trading low frequency performance as a result of the larger effective enclosure openings.

Increasing the mass of a larger speaker in order to obtain lower frequency response has been accomplished by adding a papier mache weight to the center of the speaker cone on a conventional speaker so that speaker may be used in a smaller enclosure. The addition of weight lowers the resonance of the speaker so that when it is coupled to an enclosure the added mass to the loud speaker diaphragm will help to lower the overall resonance of the loud speaker and enclosure together. Although the added weight lowers the resonance of the loud speaker, its ability to reproduce higher frequencies has been traded for the lower resonance.

Often times additional openings will be provided in the enclosure and are connected to ducting within the enclosure in order to tune the overall resonance of the system while allowing the energy from the rear of the loud speaker cone to be added to the front wave which has met with reasonable success.

Another conventional device to further tune the enclosure is by the addition of a passive radiator which serves to transfer sound into the surrounding outside area.

Another problem associated with the use of large speaker assemblies or passive radiators for that matter, is the tendency for these large diaphragms to continue ringing after the electrical signal has been terminated from the driver.

Conventional drivers are mounted in loudspeaker enclosures with the face of the enclosure being utilized as the radiator while the remainder of the enclosure being utilized as the radiator while the remainder of the enclosure is used as a sound or acoustic energy absorption device. In structures of this nature the driver is physically attached to the face plate and the enclosure has walls formed of nonresonant material with a high sound absorption coefficient, the walls of such enclosures being of a relatively high mass and thickness in order to facilitate maximum sound absorption. In addition, these enclosures are usually filled or stuffed with sound absorbent material such as cotton, fiberglass, etc. Such conventional speaker structure intends the radiation of the principal sound from the front of the enclosure and provides for the reduction or control of sounds which emanate from the rear of the driver cone since sounds emanating from the back side of the cone are essentially 190 degrees out of phase with the forward sound and would effectively cancel the forward sound an would effectively cancel the forward sound wave if the two were permitted to comingle. This 180 degrees out of phase sound pressure wave is normally referred to as the back wave and, in addition to possessing high orders of audio energy that must be controlled, reacts within the interior of the loudspeaker enclosure (which in reality is a chamber or series of chambers) to create standing waves of high energy sound plus a counterforce of nodes or low energy areas. In addition, any structural material in the vicinity is invaded through the molecular framework of the material by the primary frequencies of the front and back waves plus all of the supporting harmonics thereof, the totality of which creates vibration resonances commensurate with the mass, tension and composition of the material utilized in the enclosure structure.

A profusion of resonances is thus activated by the driver from the driver chamber or chambers, sides, top bottom, back, etc., it being necessary to bring all of these resonances under some semblance of control if the audio reproduction is to be properly presented.

Control of enclosure oriented sound energy has been directly related to the ability to engage and rapidly convert these waves of pressure energy to other forms of energy. The frequency range of audio sound is such that the most practicable means, and hence, the basic control method that has previously emerged, is the conversion of kinetic pressure energy into heat energy. This conversion process involves insertion of materials with very high fiber count into the pathway of the audio wave. In attempting to penetrate the material, the audio wave will cause the individual fibers of the material to vibrate, thus absorbing and converting the audio energy into heat energy. Materials possessing a very high fiber count, such as cotton, fiberglass, particle board and the like are commonly used. Unfortunately, the efficiency of high fiber count material is quite low and no material has yet surfaced which can effectively absorb and dissipate audio frequencies of the size typically used for loudspeakers in sound reproduction systems. Within the state of the art, high degrees of sound absorption can only be realized by developing anechoic conditions. However, the attainment of anechoic conditions requires the use of expensive materials, specialized construction techniques and air volumes of excessively large proportions, all of which tend to make the anechoic application impractical for typical loudspeaker enclosures.

Accordingly, prior practices in the art have only been able to contain the diverse resonances and undesirable sounds within and emanating from loudspeaker enclosures to that level of efficiency and effectiveness constrained by the commonly available high fiber count materials. These materials have of necessity been used regardless of unfavorable mass and weight considerations and even with the recognition that the materials cannot differentiate between desirable and undesirable audio sounds. In spite of the shortcomings attendant to the prior practices thus enumerated, two predominant designs of loudspeaker enclosures have previously emerged and are almost exclusively constitute conventional practice, these designs being describable as the sealed enclosure, better known as the "infinite baffle," and the ported box enclosure, most commonly referred to as the "bass reflex."

In the infinite baffle design, the backwave is sealed within the enclosure. The concept involves the use of all solid wall, thereby resulting in the rear wave being prevented from engaging the front wave. Further, high fiber construction material is used to stuff the interior of the enclosure, the high fiber count suppressing the many resonances and unwanted enclosure sounds. In practice, the practical size of a sealed enclosure is severely limited in comparison to the length of the sound waves encountered.

Now referring to the prior art, the patent to Pitre, U.S. Pat. No. 4,031,318, issued Jun. 21, 1977 for "High Fidelity Loudspeaker Systems" shows ducting surrounding the speaker but does not reduce the effective area of the opening.

SPEAKER ENCLOSURE

Howard Rodgers

U.S. Pat. No. 5,012,889

A loudspeaker enclosure accommodates at least one speaker in the front wall of the enclosure. The interior of the enclosure is divided into two smaller chambers by means of a partition inclined with respect to the front and rear walls. One such chamber is adjacent to the speaker, while the second or rear chamber is separated from the front chamber by the partition. Below the speaker is a vent or port in communication with the rear chamber. Sound waves emanating from the rear of the speaker are reflected by the inclined partition and reflected upwardly toward the top of the speaker enclosure. The partition does not extend to the top wall of the enclosure, thereby allowing sound waves to reflect off of the top wall and enter the rear chamber. The sound waves then exit the enclosure through the port below the speaker. The rear waves are thus delayed with respect to the front waves from the speaker to achieve the desired tuning of the speaker system. Furthermore, the arrangement of the interior partition causes the rear waves to be compressed at two location thereby increasing the effective delay and further improving low frequency response.

SPEAKER CABINET HAVING INTERACTIVE SPEAKERS

Rollie W. Paulson

U.S. Pat. No. 4,635,748

A speaker cabinet of the type used in stereo systems. A horizontal wall partitions the interior of the cabinet into an upper portion within which is positioned a full range speaker member, and a lower portion within which is positioned a low range speaker member. A pair of laterally spaced ports are formed in the partition wall to allow sound emanating from the low range speaker to enter into the upper portion of the cabinet. A horn associated with the full range speaker is spaced apart therefrom, in nonattached relation thereto to define a space between the full range speaker and the horn. Sound from the low range speaker and from the full range speaker enters into the space between the full range speaker and the horn and mixes so that the sound emanating from the horn is a full bodied sound characterized by minimal distortion and substantial absence of unpleasing sounds of the type associated with speakers of the prior art.

METHOD AND APPARATUS FOR AUGMENTATION OF SOUND BY ENHANCED RESONANCE

John E. Skaggs, Jr.

U.S. Pat. No. 4,714,133

The invention presents a method for improving overall efficiency and quality in sound reproduction systems by providing a system which establishes positive phase control over the many and varied resonant characteristics encountered in the reproduction and presentation of audio energy. The apparatus embodying the present method primarily consists of speaker structures within which drivers such as conventional cone drivers are acoustically coupled to both air and to the materials from which the enclosure of the speaker structure is formed by optimizing existing atmospheric pressure differentials and induced audio vibration readily available within these structures. The coupling is obtained through the use of acoustical resonator structure placed within a speaker enclosure an through particular distribution of mass in the enclosure and the materials.

ACOUSTICAL DUCTING FOR SPEAKERS AND ENCLOSURES

Dan R. Sherman

U.S. Pat. No. 4,618,025

In an acoustical speaker having a movable diaphragm responsive over a range of frequencies, an air duct having a cross-sectional area less than that of the diaphragm substantially surrounding the diaphragm and in communication with one side thereof for acoustically isolating the diaphragm, dampening low-frequency ringing and acoustically loading the diaphragm for extending the frequency range to lower frequencies to enhance the performance of the speaker with small speaker enclosures. One embodiment provides for similar ducting for passive radiator diaphragms.

Numerous innovations for speaker cabinets have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a speaker cabinet.

More particularly, it is an object of the present invention to provide a speaker cabinet having multi-dimensional speaker systems.

It is therefore clear that the primary object of the invention is to advance the art of speaker cabinet design in a radical, pioneering way.

A more specific object is to pioneer the art of speaker systems having better sound distribution with left and right channels placed in one speaker cabinet giving the listener a full spectrum of sound.

Another object is to provide a speaker system that separates a full range speaker system from a low range speaker system by a partition having one or more openings formed therein to permit sound mixing and a built in sub-woofer is not vented to the floor which would be muffled on a carpeted floor, it is vented from the base of the speaker.

The invention primarily provides a speaker cabinet for utilizing that portion of the many resonances, and other acoustic energy sources available within loudspeaker enclosures, currently being used to provide higher efficiencies and quality improvement in sound reproduction. The particular speaker structures of the invention set to place under positive control the backwave which emanates from a conventional cone driver, the present structure acting further to acoustically couple within the same operating chamber one or more cone drivers or similar drivers to both the air and to the materials from which the enclosure of the speaker is formed. The structure of the present speaker cabinet also acts to control acoustical interference created by resonances, standing waves, nodes, and other nuances within the enclosure itself. The nature of the present speaker cabinet allows additional advantages such as simplicity of design and construction not constrained by size, weight or material. The present speaker cabinet thereby provides high efficiencies and superior sound reproduction through the placement of acoustical resonator structure,port, within the enclosure per Accordingly, it is a primary objective of the invention to provide speaker structure and particularly speaker enclosure structure which places under positive control the backwave emanating from the driver cone.

A further object of the invention is a multi-sided speaker system whereas sound emanates from all four sides, the tweeter and mid-range assembly on the top of the speaker cabinet and the self contained, sub-woofer on the bottom of the sound square. The sound square may also have three sets of elements or two sets of elements which moves them from being a sound square to being a three sided or two sided sound bank. On the sound track system, the rotation of each stack is 180 degrees and stop from the center. On the sound angle, a right side is constructed in a similar fashion, however, the elements are different.

Another object of the present invention is to provide a speaker enclosure which substantially eliminates acoustical interference created by resonances, standing waves and nodes within the enclosure itself.

A further object of the invention is to provide speaker enclosure of simple design which can be formed of varying materials including thin walled materials, the enclosures themselves being of a reasonable size and weight relative to the quality of sound produced.

In the case of an active speaker diaphragm, the ducting substantially surrounds the rear surface of the diaphragm and provides a restricted air passageway between the rear surface of the diaphragm and the interior of the enclosure. This ducting between the diaphragm and the enclosure serves to effectively reduce the area of the opening occupied by the driver. The amount of area reduction naturally depends on the size of the duct but because the enclosure opening can be effectively reduced in area, enclosure opening can be effectively reduced in area, enclosure resonance remains low thereby enabling the system to respond at low frequencies in the region of the resonance. Whereas the use of the duct,port, somewhat reduces efficiency, use of the larger driver more than offsets this reduction in efficiency and the net result is higher efficiency for the same enclosure size.

The present invention provides for acoustical ducting to be operably connected to the vibrating diaphragms themselves, whether they be active or passive, as opposed to simple ducting within the speaker enclosure itself. The present invention provides ducting,ports, to make possible low frequency response from a loud speaker system having an enclosure that is smaller, in proportion to the moving speaker elements, than the enclosures used in conventional designs, all without serious tradeoffs of desirable for undesirable characteristics.

Other advantages of using the ducting in this manner also become apparent. Air that is moved by the rear of the loud speaker cone or diaphragm is forced to move through this restrictive ducting, port, which, because of the reduced area, serves to restrict the air flow and thus, dampens the movement of the loud speaker cone to prevent ringing after the electric signal is terminated.

Further, since a specific air mass is enclosed within the volume of the duct, the air mass has a specific resonance. This air mass serves to couple to the mass of the diaphragm which, at low frequencies, tends to have the effect of adding mass to the driver to lower the resonance of the driver. However, since the air is somewhat springy, high frequency performance is substantially unaffected.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF LIST OF REFERENCE NUMERALS UTILIZED IN THE DRAWING

10—multi-dimensional speaker system 10
10A—multi-dimensional speaker system first side 10A
10B—multi-dimensional speaker system second side 10B
10C—multi-dimensional speaker system third side 10C
10D—multi-dimensional speaker system forth side 10D
10E—multi-dimensional speaker system top side 10E
10F—multi-dimensional speaker system side cover 10F
10G—multi-dimensional speaker system top side cover 10G
10H—multi-dimensional speaker system sound radiator 10H
10AA—multi-dimensional speaker system first upper side 10AA
10BB—multi-dimensional speaker system second upper side 10BB
10CC—multi-dimensional speaker system third upper side 10CC
10DD—multi-dimensional speaker system forth upper side 10DD
10AAA—multi-dimensional speaker system first lower side 10AAA
10BBB—multi-dimensional speaker system second lower side 10BBB
10CCC—multi-dimensional speaker system third lower side 10CCC
10DDD—multi-dimensional speaker system forth lower side 10DDD
12—mid-range horn 12
14—air port 14
18—mid-range 18
18A—mid-range control knob 18A
20—tweeter 20
20A—tweeter control knob 20A
22—sub-woofer 22
22A—sub-woofer controlling knob 22A
22B—sub-woofer enclosure 22B
22C—sub-woofer vent hole 22C
24—multi-dimensional speaker system speaker baffle 24
24A—multi-dimensional speaker system first side speaker baffle 24A
24B—multi-dimensional speaker system second side speaker baffle 24B
24C—multi-dimensional speaker system third side speaker baffle 24C
24D—multi-dimensional speaker system forth side speaker baffle 24D
26—multi-dimensional speaker system spacer 26
26A—multi-dimensional speaker system first side spacer 26A
26B—multi-dimensional speaker system second side spacer 26B
26C—multi-dimensional speaker system third side spacer 26C
26D—multi-dimensional speaker system forth side spacer 26D
28A—left speaker wire connector 28A
28B—right speaker connector 28B
30—woofer 30
32—room containing sound system 32
34—2-way square soundbank 34
34A—3-way square soundbank 34A
36—4-way square soundbank 36
38—2-way triangular soundbank 38
40—3-way triangular soundbank 40
42—rectangular entertainment center 42

DETAILED LIST OF REFERENCE NUMERALS UTILIZED IN THE DRAWING

10—multi-dimensional speaker system 10 having multiple sides containing numerous speakers, air baffles and speaker baffles

10A—multi-dimensional speaker system first side 10A having an air baffle 14 positioned at the upper right hand corner, a mid-range 18 positioned at the middle left hand side, a mid-range control knob 18A, a plurality of tweeters 20 positioned at the upper left hand corner, a tweeter control knob 20A, a sub-woofer 22 positioned at the lower left side, a multi-dimensional speaker system first side speaker baffle 24A positioned at the bottom, and multi-dimensional speaker system first side spacer 26A

10B—multi-dimensional speaker system second side 10B having an air baffle 14 positioned at the lower right hand corner, a mid-range 18 positioned at the middle right hand side, a mid-range control knob 18A, a plurality of tweeters 20 positioned at the lower left hand corner, a tweeter control knob 20A, a sub-woofer 22 positioned at the lower left side, a multi-dimensional speaker system second side speaker baffle 24B positioned at the bottom, and multi-dimensional speaker system second side spacer 26B

10C—multi-dimensional speaker system third side 10C having an air baffle 14 positioned at the upper right hand corner, a mid-range 18 positioned at the middle left hand side, a midrange control knob 18A, a plurality of tweeters 20 positioned at the upper left hand corner, a tweeter control knob 20A, a sub-woofer 22 positioned at the lower left side, a multi-dimensional speaker system third side speaker baffle 24C positioned at the bottom, and multi-dimensional speaker system third side spacer 26C

10D—multi-dimensional speaker system forth side 10D having an air baffle 14 positioned at the lower right hand corner, a midrange 18 positioned at the middle right hand side, a midrange control knob 18A, a plurality of tweeters 20 positioned at the lower left hand corner, a tweeter control knob 20A, a sub-woofer 22 positioned at the lower left side, a multi-dimensional speaker system forth side speaker baffle 24D positioned at the bottom, and multi-dimensional speaker system forth side spacer 26D

10E—multi-dimensional speaker system top side 10E having a plurality of midrange speakers 18 mounted diagonally opposite one another and a plurality of tweeters 20 mounted therebetween

10F—multi-dimensional speaker system side cover 10F covering and protecting said multi-dimensional speaker system first side 10A

10G—multi-dimensional speaker system top side cover 10G covering and protecting said multi-dimensional speaker system top side 10E

10H—multi-dimensional speaker system sound radiator 10H positioned between a floor and said multi-dimensional speaker system 10 functioning to enhance radiation of sounds therefrom being able to rotate in omni directions having swivels therebetween said upper 10 AA–10 DD and lower 10 AAA–10 DDD speakers as well as said lower speaker 10AAA–10 DDD and said multi-dimensional speaker system sound radiator 10H

10AA—multi-dimensional speaker system first upper side 10AA having a plurality of tweeters 20 positioned at the bottom and a woofer 30 positioned at the top

10BB—multi-dimensional speaker system second upper side 10BB having a plurality of tweeters 20 positioned at the top and a woofer 30 positioned at the bottom

10CC—multi-dimensional speaker system third upper side 10CC having a plurality of tweeters 20 positioned at the bottom and a woofer 30 positioned at the top

10DD—multi-dimensional speaker system forth upper side 10DD having a plurality of tweeters 20 positioned at the top and a woofer 30 positioned at the bottom

10AAA—multi-dimensional speaker system first lower side 10AAA having a plurality of tweeters 20 positioned at the top and a woofer 30 positioned at the bottom, a multi-dimensional speaker system first side speaker baffle 24A positioned at the bottom, and a multi-dimensional speaker system first side spacer 26A positioned at the bottom underneath said multi-dimensional speaker system first side speaker baffle 24A

10BBB—multi-dimensional speaker system second lower side 10BBB having a plurality of tweeters 20 positioned at the bottom and a woofer 30 positioned at the top, a multi-dimensional speaker system second side speaker baffle 24B positioned at the bottom, and a multi-dimensional speaker system second side spacer 26B positioned at the bottom underneath said multi-dimensional speaker system second side speaker baffle 24B

10CCC—multi-dimensional speaker system third lower side 10CCC having a plurality of tweeters 20 positioned at the top and a woofer 30 positioned at the bottom, a multi-dimensional speaker system third side speaker baffle 24C positioned at the bottom, and a multi-dimensional speaker system third side spacer 26C positioned at the bottom underneath said multi-dimensional speaker system third side speaker baffle 24C

10DDD—multi-dimensional speaker system forth lower side 10DDD having a plurality of tweeters 20 positioned at the bottom and a woofer 30 positioned at the top, a multi-dimensional speaker system forth side speaker baffle 24D positioned at the bottom, and a multi-dimensional speaker system forth side spacer 26D positioned at the bottom underneath said multi-dimensional speaker system forth side speaker baffle 24D

12—mid-range horn 12 producing sound in the middle range of octaves

14—air port 14 allowing sound produced within the speaker cabinet to resonate outwardly

18—mid-range 18 producing sound in the middle range of octaves

18A—mid-range control knob 18A controlling the mid-range sound output

20—tweeter 20 producing sound in the upper range of octaves

20A—tweeter control knob 20A controlling the tweeter sound output

22—sub-woofer 22 producing sound in the lower range of octaves

22A—sub-woofer controlling knob 22A functioning to control the sound output of said sub-woofer 22

22B—sub-woofer enclosure 22B housing the sub-woofer 22 therein

22C—sub-woofer vent hole 22C allows resonated sound to be expelled from the sub-woofer enclosure 22B

24—multi-dimensional speaker system speaker baffle 24 allowing sound produced within the speaker cabinet to resonate outwardly

24A—multi-dimensional speaker system first side speaker baffle 24A allowing sound produced within the speaker cabinet to resonate outwardly

24B—multi-dimensional speaker system second side speaker baffle 24B allowing sound produced within the speaker cabinet to resonate outwardly

24C—multi-dimensional speaker system third side speaker baffle 24C allowing sound produced within the speaker cabinet to resonate outwardly

24D—multi-dimensional speaker system forth side speaker baffle 24D allowing sound produced within the speaker cabinet to resonate outwardly

26—multi-dimensional speaker system spacer 26 providing a space whereby the multi-dimensional speaker system speaker baffle 24 is suspended away from the floor, thus, allowing increased and purer sound reproduction

26A—multi-dimensional speaker system first side spacer 26A providing a space whereby the multi-dimensional speaker system first side speaker baffle 24A is suspended away from the floor, thus, allowing increased and purer sound reproduction

26B—multi-dimensional speaker system second side spacer 26B providing a space whereby the multi-dimensional speaker system second side speaker baffle 24B is suspended away from the floor, thus, allowing increased and purer sound reproduction

26C—multi-dimensional speaker system third side spacer 26C providing a space whereby the multi-dimensional speaker system third side speaker baffle 24C is suspended away from the floor, thus, allowing increased and purer sound reproduction

26D—multi-dimensional speaker system forth side spacer 26D providing a space whereby the multi-dimensional speaker system forth side speaker baffle 24D is suspended away from the floor, thus, allowing increased and purer sound reproduction

28A—left speaker wire connector 28A connects the multi-dimensional speaker 10 to an amplifier

28B—right speaker connector 28B connects the multi-dimensional speaker 10 to an amplifier

30—woofer 30 producing sound in the lowest range of octaves

32—room containing sound system 32 containing within the multi-dimensional speaker system 10 specifically arranged to enhance sound

34—2-way square soundbank 34 producing sound in a dual direction at right angles to one another while being positioned against the wall

34A—3-way square soundbank 34A producing sound in three directions being in front and on both sides while being positioned against the wall

36—4-way square soundbank 36 producing sound in all four directions while being positioned away from the wall

38—2-way triangular soundbank 38 producing sound in two directions being at an obtuse angle to one another

40—3-way triangular soundbank 40 producing sound in three directions each of which being at an obtuse angle to one another

42—rectangular entertainment center 42 having all stereo and other music producing equipment contained therein

BRIEF DESCRIPTION OF THE DRAWING

FIG. 5A is a perspective view of a of a multi-dimensional speaker system exhibiting covers mounted on sides and top;

FIG. 5B is a perspective view of a of a multi-dimensional speaker system having speakers mounted on all sides and venting at the bottom;

FIG. 6 is a front view of a of a multi-dimensional speaker system exhibiting all four sides;

FIG. 7 is a top view of a sub-woofer vented on all four sides having a speaker baffle contained therein;

FIG. 8 is a top view of a of a multi-dimensional speaker system having a cross over wiring system;

DETAILED DESCRIPTION OF THE PREFERRED EMBODIMENT

Figure 1A:
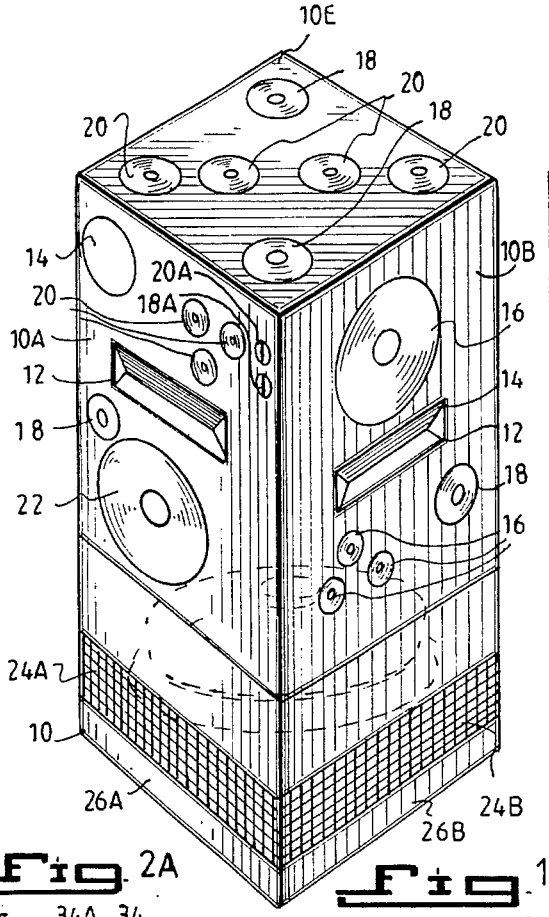
FIG. 1A is a perspective view of a multi-dimensional speaker system.

Firstly, referring to FIG. 1A which is a perspective view of a multi-dimensional speaker system exhibiting the following features: multi-dimensional speaker system 10 having multiple sides containing numerous speakers, air baffles and speaker baffles; multi-dimensional speaker system first side 10A having an air baffle 14 positioned at the upper right hand corner, a mid-range 18 positioned at the middle left hand side, a mid-range control knob 18A, a plurality of tweeters 20 positioned at the upper left hand corner, a tweeter control knob 20A, a sub-woofer 22 positioned at the lower left side, a multi-dimensional speaker system first side speaker baffle 24A positioned at the bottom, and multi-dimensional speaker system first side spacer 26A; multi-dimensional speaker system second side 10B having an air baffle 14 positioned at the lower right hand corner, a mid-range 18 positioned at the middle right hand side, a mid-range control knob 18A, a plurality of tweeters 20 positioned at the lower left hand corner, a tweeter control knob 20A, a sub-woofer 22 positioned at the lower left side, a multi-dimensional speaker system second side speaker baffle 24B positioned at the bottom, and multi-dimensional speaker system second side spacer 26B; multi-dimensional speaker system top side 10E having a plurality of mid-range speakers 18 mounted diagonally opposite one another and a plurality of tweeters 20 mounted therebetween; mid-range horn 12 producing sound in the middle range of octaves; air port 14 allowing sound produced within the speaker cabinet to resonate outwardly; mid-range 18 producing sound in the middle range of octaves; tweeter 20 producing sound in the upper range of octaves 22—sub-woofer 22 producing sound in the lower range of octaves; multi-dimensional speaker system speaker baffle 24 allowing sound produced within the speaker cabinet to resonate outwardly comprising a multi-dimensional speaker system first side speaker baffle 24A allowing sound produced within the speaker cabinet to resonate outwardly and a multi-dimensional speaker system second side speaker baffle 24B allowing sound produced within the speaker cabinet to resonate outwardly; and multi-dimensional speaker system spacer 26 providing a space whereby the multi-dimensional speaker system speaker baffle 24 is suspended away from the floor, thus, allowing increased and purer sound reproduction, comprising a multi-dimensional speaker system first side spacer 26A providing a space whereby the multi-dimensional speaker system first side speaker baffle 24A is suspended away from the floor, thus, allowing increased and purer sound reproduction and a multi-dimensional speaker system second side spacer 26B providing a space whereby the multi-dimensional speaker system second side speaker baffle 24B is suspended away from the floor, thus, allowing increased and purer sound reproduction.

Figure 1B:
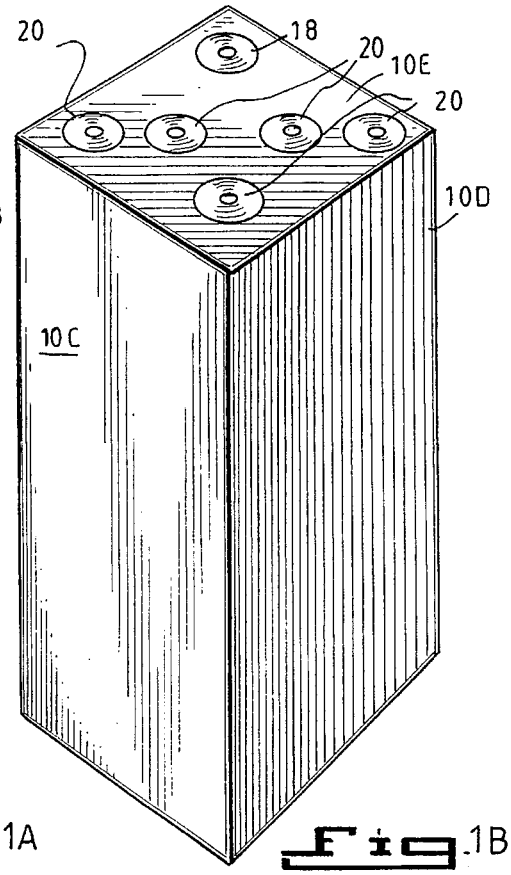
FIG. 1B is a perspective view of a multi-dimensional speaker system exhibiting speaker mounting at the top of the cabinet.

Now referring to FIG. 1B which is a perspective view of a 2-way multi-dimensional speaker system exhibiting speaker mounting at the top of the cabinet exhibiting the following features: multi-dimensional speaker system 10 having multiple sides containing numerous speakers, air baffles and speaker baffles; multi-dimensional speaker system third side 10C having an air baffle 14 positioned at the upper right hand corner, a mid-range 18 positioned at the middle left hand side, a mid-range control knob 18A, a plurality of tweeters 20 positioned at the upper left hand corner, a tweeter control knob 20A, a sub-woofer 22 positioned at the lower left side, a multi-dimensional speaker system third side speaker baffle 24C positioned at the bottom, and multi-dimensional speaker system third side spacer 26C; multi-dimensional speaker system forth side 10D having an air baffle 14 positioned at the lower right hand corner, a mid-range 18 positioned at the middle right hand side, a mid-range control knob 18A, a plurality of tweeters 20 positioned at the lower left hand corner, a tweeter control knob 20A, a sub-woofer 22 positioned at the lower left side, a multi-dimensional speaker system forth side speaker baffle 24D positioned at the bottom, and multi-dimensional speaker system forth side spacer 26D; multi-dimensional speaker system top side 10E having a plurality of mid-range speakers 18 mounted diagonally opposite one another and a plurality of tweeters 20 mounted therebetween; mid-range 18 producing sound in the middle range of octaves; mid-range control knob 18A controlling the mid-range sound output; and tweeter 20 producing sound in the upper range of octaves.

Figure 2A:
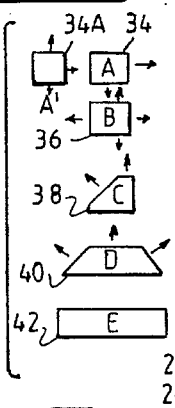
FIG. 2A is a diagrammatic view of a multi-dimensional speaker system.
Figure 2B:
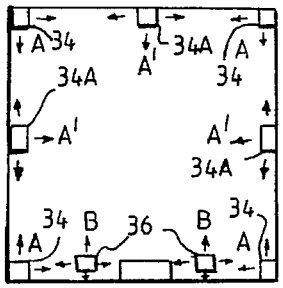
FIG. 2B is a top view of a multi-dimensional speaker system specifically arranged in a room.

Now referring to FIG. 2A which is a diagrammatic view of a multi-dimensional speaker system exhibiting the following features:

Now referring to FIG. 2B which is a top view of a multi-dimensional speaker system in a room enclosure exhibiting the following features:2-way square soundbank 34 producing sound in a dual direction at right angles to one another while being positioned against the wall; 3-way square soundbank 34A producing sound in three directions being in front and on both sides while being positioned against the wall; 4-way square soundbank 36 producing sound in all four directions while being positioned away from the wall; 2-way triangular soundbank 38 producing sound in two directions being at an obtuse angle to one another; 3-way triangular soundbank 40 producing sound in three directions each of which being at an obtuse angle to one another; and rectangular entertainment center 42 having all stereo and other music producing equipment contained therein.

Figure 2C:
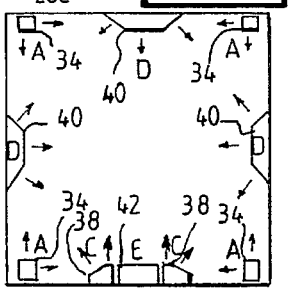
FIG. 2C is a top view of a multi-dimensional speaker system specifically arranged in a room.

Now referring to FIG. 2C which is top view of a multi-dimensional speaker system in a room enclosure exhibiting the following features: 2-way square soundbank 34 producing sound in a dual direction at right angles to one another while being positioned against the wall; 2-way triangular soundbank 38 producing sound in two directions being at an obtuse angle to one another; 3-way triangular soundbank 40 producing sound in three directions each of which being at an obtuse angle to one another; and rectangular entertainment center 42 having all stereo and other music producing equipment contained therein.

Figure 3A:
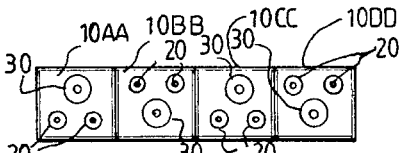
FIG. 3A is a top view of a multi-dimensional speaker system exhibiting all four tops.

Now referring to FIG. 3A which is a top view of a multi-dimensional speaker system exhibiting all four tops exhibiting the following features: multi-dimensional speaker system first upper side 10AA having a plurality of tweeters 20 positioned at the bottom and a woofer 30 positioned at the top; multi-dimensional speaker system second upper side 10BB having a plurality of tweeters 20 positioned at the top and a woofer 30 positioned at the bottom; multi-dimensional speaker system third upper side 10CC having a plurality of tweeters 20 positioned at the bottom and a woofer 30 positioned at the top; multi-dimensional speaker system forth upper side 10DD having a plurality of tweeters 20 positioned at the top and a woofer 30 positioned at the bottom; tweeter 20 producing sound in the upper range of octaves; and woofer 30 producing sound in the lowest range of octaves.

Figure 3B:
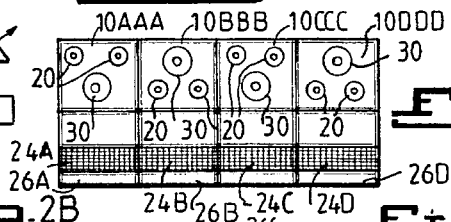
FIG. 3B is a side view of a multi-dimensional speaker system exhibiting all four sides.

Now referring to FIG. 3B which is a side view of a multi-dimensional speaker system exhibiting all four sides exhibiting the following features: multi-dimensional speaker system first lower side 10AAA having a plurality of tweeters 20 positioned at the top and a woofer 30 positioned at the bottom, a multi-dimensional speaker system first side speaker baffle 24A positioned at the bottom, and a multi-dimensional speaker system first side spacer 26A positioned at the bottom underneath said multi-dimensional speaker system first side speaker baffle 24A; multi-dimensional speaker system second lower side 10BBB having a plurality of tweeters 20 positioned at the bottom and a woofer 30 positioned at the top, a multi-dimensional speaker system second side speaker baffle 24B positioned at the bottom, and a multi-dimensional speaker system second side spacer 26B positioned at the bottom underneath said multi-dimensional speaker system second side speaker baffle 24B; multi-dimensional speaker system third lower side 10CCC having a plurality of tweeters 20 positioned at the top and a woofer 30 positioned at the bottom, a multi-dimensional speaker system third side speaker baffle 24C positioned at the bottom, and a multi-dimensional speaker system third side spacer 26C positioned at the bottom underneath said multi-dimensional speaker system third side speaker baffle 24C; multi-dimensional speaker system forth lower side 10DDD having a plurality of tweeters 20 positioned at the bottom and a woofer 30 positioned at the top, a multi-dimensional speaker system forth side speaker baffle 24D positioned at the bottom, and a multi-dimensional speaker system forth side spacer 26D positioned at the bottom underneath said multi-dimensional speaker system forth side speaker baffle 24D; tweeter 20 producing sound in the upper range of octaves; woofer 30 producing sound in the lowest range of octaves; multi-dimensional speaker system speaker baffle 24 allowing sound produced within the speaker cabinet to resonate outwardly comprising a multi-dimensional speaker system first side speaker baffle 24A allowing sound produced within the speaker cabinet to resonate outwardly, a multi-dimensional speaker system second side speaker baffle 24B allowing sound produced within the speaker cabinet to resonate outwardly, a multi-dimensional speaker system third side speaker baffle 24C allowing sound produced within the speaker cabinet to resonate outwardly, and a multi-dimensional speaker system forth side speaker baffle 24D allowing sound produced within the speaker cabinet to resonate outwardly; multi-dimensional speaker system spacer 26 providing a space whereby the multi-dimensional speaker system speaker baffle 24 is suspended away from the floor, thus, allowing increased and purer sound reproduction comprising a multi-dimensional speaker system first side spacer 26A providing a space whereby the multi-dimensional speaker system first side speaker baffle 24A is suspended away from the floor, thus, allowing increased and purer sound reproduction, a multi-dimensional speaker system second side spacer 26B providing a space whereby the multi-dimensional speaker system second side speaker baffle 24B is suspended away from the floor, thus, allowing increased and purer sound reproduction, a multi-dimensional speaker system third side spacer 26C providing a space whereby the multi-dimensional speaker system third side speaker baffle 24C is suspended away from the floor, thus, allowing increased and purer sound reproduction, and a multi-dimensional speaker system first side spacer 26D providing a space whereby the multi-dimensional speaker system forth side speaker baffle 24D is suspended away from the floor, thus, allowing increased and purer sound reproduction.

Figure 4:
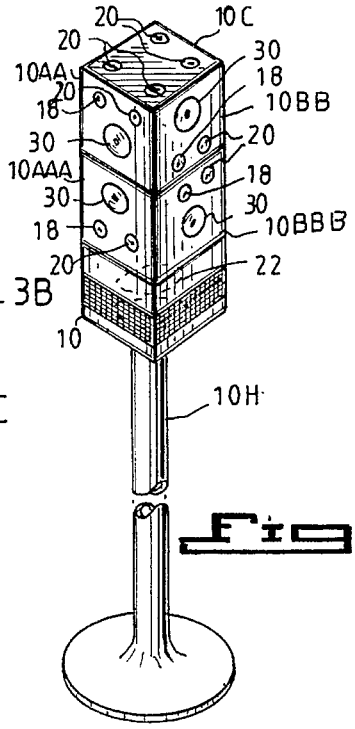
FIG. 4 is a perspective view of a of a multi-dimensional speaker system mounted on an upright stand.

Now referring to FIG. 4 which is a perspective view of a of a multi-dimensional speaker system mounted on an upright stand exhibiting the following features: multi-dimensional speaker system 10 having multiple sides containing numerous speakers, air baffles and speaker baffles; multi-dimensional speaker system first side 10A having an air baffle 14 positioned at the upper right hand corner, a mid-range 18 positioned at the middle left hand side, a mid-range control knob 18A, a plurality of tweeters 20 positioned at the upper left hand corner, a tweeter control knob 20A, a sub-woofer 22 positioned at the lower left side, a multi-dimensional speaker system first side speaker baffle 24A positioned at the bottom, and multi-dimensional speaker system first side spacer 26A; multi-dimensional speaker system second side 10B having an air baffle 14 positioned at the lower right hand corner, a mid-range 18 positioned at the middle right hand side, a mid-range control knob 18A, a plurality of tweeters 20 positioned at the lower left hand corner, a tweeter control knob 20A, a sub-woofer 22 positioned at the lower left side, a multi-dimensional speaker system second side speaker baffle 24B positioned at the bottom, and multi-dimensional speaker system second side spacer 26B; multi-dimensional speaker system third side 10C having an air baffle 14 positioned at the upper right hand corner, a mid-range 18 positioned at the middle left hand side, a mid-range control knob 18A, a plurality of tweeters 20 positioned at the upper left hand corner, a tweeter control knob 20A, a sub-woofer 22 positioned at the lower left side, a multi-dimensional speaker system third side speaker baffle 24C positioned at the bottom, and multi-dimensional speaker system third side spacer 26C; multi-dimensional speaker system forth side 10D having an air baffle 14 positioned at the lower right hand corner, a mid-range 18 positioned at the middle right hand side, a mid-range control knob 18A, a plurality of tweeters 20 positioned at the lower left hand corner, a tweeter control knob 20A, a sub-woofer 22 positioned at the lower left side, a multi-dimensional speaker system forth side speaker baffle 24D positioned at the bottom, and multi-dimensional speaker system forth side spacer 26D; multi-dimensional speaker system top side 10E having a plurality of mid-range speakers 18 mounted diagonally opposite one another and a plurality of tweeters 20 mounted therebetween; multi-dimensional speaker system sound radiator 10H positioned between a floor and said multi-dimensional speaker system 10 functioning to enhance radiation of sounds therefrom being able to rotate in omni directions having swivels therebetween said upper 10 AA–10 DD and lower 10 AAA–10 DDD speakers as well as said lower speaker 10AAA–10 DDD and said multi-dimensional speaker system sound radiator 10H; multi-dimensional speaker system first upper side 10AA having a plurality of tweeters 20 positioned at the bottom and a woofer 30 positioned at the top; multi-dimensional speaker system second upper side 10BB having a plurality of tweeters 20 positioned at the top and a woofer 30 positioned at the bottom; multi-dimensional speaker system third upper side 10CC having a plurality of tweeters 20 positioned at the bottom and a woofer 30 positioned at the top; multi-dimensional speaker system forth upper side 10DD having a plurality of tweeters 20 positioned at the top and a woofer 30 positioned at the bottom; multi-dimensional speaker system first lower side 10AAA having a plurality of tweeters 20 positioned at the top and a woofer 30 positioned at the bottom, a multi-dimensional speaker system first side speaker baffle 24A positioned at the bottom, and a multi-dimensional speaker system first side spacer 26A positioned at the bottom underneath said multi-dimensional speaker system first side speaker baffle 24A; multi-dimensional speaker system second lower side 10BBB having a plurality of tweeters 20 positioned at the bottom and a woofer 30 positioned at the top, a multi-dimensional speaker system second side speaker baffle 24B positioned at the bottom, and a multi-dimensional speaker system second side spacer 26B positioned at the bottom underneath said multi-dimensional speaker system second side speaker baffle 24B; multi-dimensional speaker system third lower side 10CCC having a plurality of tweeters 20 positioned at the top and a woofer 30 positioned at the bottom, a multi-dimensional speaker system third side speaker baffle 24C positioned at the bottom, and a multi-dimensional speaker system third side spacer 26C positioned at the bottom underneath said multi-dimensional speaker system third side speaker baffle 24C; multi-dimensional speaker system forth lower side 10DDD having a plurality of tweeters 20 positioned at the bottom and a woofer 30 positioned at the top, a multi-dimensional speaker system forth side speaker baffle 24D positioned at the bottom, and a multi-dimensional speaker system forth side spacer 26D positioned at the bottom underneath said multi-dimensional speaker system forth side speaker baffle 24D; mid-range horn 12 producing sound in the middle range of octaves; air port 14 allowing sound produced within the speaker cabinet to resonate outwardly; mid-range 18 producing sound in the middle range of octaves; mid-range control knob 18A controlling the mid-range sound output; tweeter 20 producing sound in the upper range of octaves; tweeter control knob 20A controlling the tweeter sound output; and sub-woofer 22 producing sound in the lower range of octaves.

Now referring to FIG. 5A which is a perspective view of a of a multi-dimensional speaker system exhibiting covers mounted on sides and top exhibiting the following features: multi-dimensional speaker system 10 having multiple sides containing numerous speakers, air baffles and speaker baffles; multi-dimensional speaker system side cover 10F covering and protecting said multi-dimensional speaker system first side 10A; and multi-dimensional speaker system top side cover 10G covering and protecting said multi-dimensional speaker system top side 10E.

Now referring to FIG. 5B which is a perspective view of a of a multi-dimensional speaker system having speakers mounted on all sides and venting at the bottom exhibiting the following features: multi-dimensional speaker system 10 having multiple sides containing numerous speakers, air baffles and speaker baffles; multi-dimensional speaker system first side 10A having an air baffle 14 positioned at the upper right hand corner, a mid-range 18 positioned at the middle left hand side, a mid-range control knob 18A, a plurality of tweeters 20 positioned at the upper left hand corner, a tweeter control knob 20A, a sub-woofer 22 positioned at the lower left side, a multi-dimensional speaker system first side speaker baffle 24A positioned at the bottom, and multi-dimensional speaker system first side spacer 26A; multi-dimensional speaker system second side 10B having an air baffle 14 positioned at the lower right hand corner, a mid-range 18 positioned at the middle right hand side, a mid-range control knob 18A, a plurality of tweeters 20 positioned at the lower left hand corner, a tweeter control knob 20A, a sub-woofer 22 positioned at the lower left side, a multi-dimensional speaker system second side speaker baffle 24B positioned at the bottom, and multi-dimensional speaker system second side spacer 26B; multi-dimensional speaker system top side 10E having a plurality of mid-range speakers 18 mounted diagonally opposite one another and a plurality of tweeters 20 mounted therebetween; mid-range horn 12 producing sound in the middle range of octaves; air port 14 allowing sound produced within the speaker cabinet to resonate outwardly; mid-range 18 producing sound in the middle range of octaves; mid-range control knob 18A controlling the mid-range sound output; tweeter 20 producing sound in the upper range of octaves; tweeter control knob 20A controlling the tweeter sound output; sub-woofer 22 producing sound in the lower range of octaves; multi-dimensional speaker system speaker baffle 24 allowing sound produced within the speaker cabinet to resonate outwardly comprising a multi-dimensional speaker system first side speaker baffle 24A allowing sound produced within the speaker cabinet to resonate outwardly, and a multi-dimensional speaker system second side speaker baffle 24B allowing sound produced within the speaker cabinet to resonate outwardly; multi-dimensional speaker system spacer 26 providing a space whereby the multi-dimensional speaker system speaker baffle 24 is suspended away from the floor, thus, allowing increased and purer sound reproduction comprising a multi-dimensional speaker system first side spacer 26A providing a space whereby the multi-dimensional speaker system first side speaker baffle 24A is suspended away from the floor, thus, allowing increased and purer sound reproduction, and a multi-dimensional speaker system second side spacer 26B providing a space whereby the multi-dimensional speaker system second side speaker baffle 24B is suspended away from the floor, thus, allowing increased and purer sound reproduction.

Now referring to FIG. 6 which is a front view of a of a multi-dimensional speaker system exhibiting all four sides exhibiting the following features: mid-range horn 12; air port 14; mid-range 18; mid-range control knob 18A; tweeter 20; tweeter control knob 20A; and sub-woofer 22.

Now referring to FIG. 7 which is a top view of a sub-woofer vented on all four sides having a speaker baffle contained therein exhibiting the following features: sub-woofer 22 producing sound in the lower range of octaves; sub-woofer controlling knob 22A functioning to control the sound output of said sub-woofer 22; sub-woofer enclosure 22B housing the sub-woofer 22 therein; and sub-woofer vent hole 22C allows resonated sound to be expelled from the sub-woofer enclosure 22B.

Now referring to FIG. 8 which is a top view of a of a multi-dimensional speaker system having a cross over wiring system exhibiting the following features: a first mid-range 18 producing sound in the middle range of octaves having a cross-over wiring to at least two tweeters 20 being positioned in a first and third diagonal position from said mid-range and a second mid-range 18 producing sound in the middle range of octaves having a cross-over wiring to at least two tweeters 20 being positioned in a second and forth diagonal position from said mid-range; mid-range control knob 18A controlling the mid-range sound output; and tweeter control knob 20A controlling the tweeter sound output.

Figure 9A:
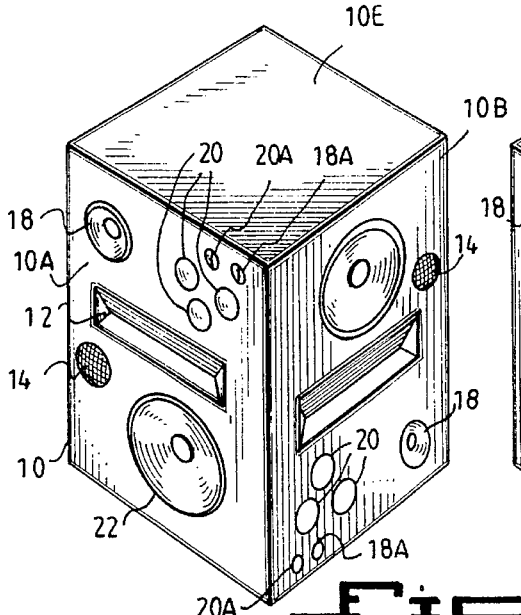
FIG. 9A is a perspective view of a of a multi-dimensional speaker system having numerous speakers contained therein.

Now referring to FIG. 9A which is a front perspective view of a of a 2-way multi-dimensional speaker system having numerous speakers contained therein exhibiting the following features: multi-dimensional speaker system 10 having multiple sides containing numerous speakers, air baffles and speaker baffles; multi-dimensional speaker system first side 10A having an air baffle 14 positioned at the upper right hand corner, a mid-range 18 positioned at the middle left hand side, a mid-range control knob 18A, a plurality of tweeters 20 positioned at the upper left hand corner, a tweeter control knob 20A, a sub-woofer 22 positioned at the lower left side, a multi-dimensional speaker system first side speaker baffle 24A positioned at the bottom, and multi-dimensional speaker system first side spacer 26A; multi-dimensional speaker system second side 10B having an air baffle 14 positioned at the lower right hand corner, a mid-range 18 positioned at the middle right hand side, a mid-range control knob 18A, a plurality of tweeters 20 positioned at the lower left hand corner, a tweeter control knob 20A, a sub-woofer 22 positioned at the lower left side, a multi-dimensional speaker system second side speaker baffle 24B positioned at the bottom, and multi-dimensional speaker system second side spacer 26B; multi-dimensional speaker system top side 10E having a plurality of mid-range speakers 18 mounted diagonally opposite one another and a plurality of tweeters 20 mounted therebetween; mid-range horn 12 producing sound in the middle range of octaves; air port 14 allowing sound produced within the speaker cabinet to resonate outwardly; mid-range 18 producing sound in the middle range of octaves; mid-range control knob 18A controlling the mid-range sound output; and tweeter 20 producing sound in the upper range of octaves; and tweeter control knob 20A controlling the tweeter sound output.

Figure 9B:
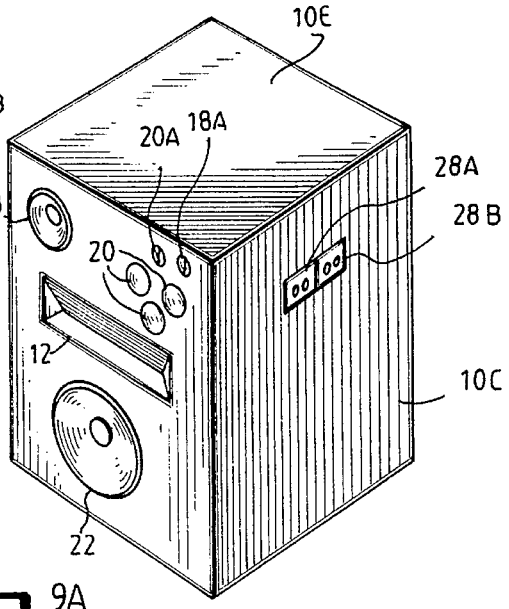
FIG. 9B is a perspective view of a of a multi-dimensional speaker system having numerous speakers and speaker wire connectors contained therein.

Now referring to FIG. 9B which is a rear perspective view of a of a 2-way multi-dimensional speaker system having numerous speakers and speaker wire connectors contained therein exhibiting the following features: multi-dimensional speaker system 10 having multiple sides containing numerous speakers, air baffles and speaker baffles; multi-dimensional speaker system first side 10A having an air baffle 14 positioned at the upper right hand corner, a mid-range 18 positioned at the middle left hand side, a mid-range control knob 18A, a plurality of tweeters 20 positioned at the upper left hand corner, a tweeter control knob 20A, a sub-woofer 22 positioned at the lower left side, a multi-dimensional speaker system first side speaker baffle 24A positioned at the bottom, and multi-dimensional speaker system first side spacer 26A; multi-dimensional speaker system second side 10B having an air baffle 14 positioned at the lower right hand corner, a mid-range 18 positioned at the middle right hand side, a mid-range control knob 18A, a plurality of tweeters 20 positioned at the lower left hand corner, a tweeter control knob 20A, a sub-woofer 22 positioned at the lower left side, a multi-dimensional speaker system second side speaker baffle 24B positioned at the bottom, and multi-dimensional speaker system second side spacer 26B; multi-dimensional speaker system top side 10E having a plurality of mid-range speakers 18 mounted diagonally opposite one another and a plurality of tweeters 20 mounted therebetween; mid-range horn 12 producing sound in the middle range of octaves; air port 14 allowing sound produced within the speaker cabinet to resonate outwardly; mid-range 18 producing sound in the middle range of octaves; mid-range control knob 18A controlling the mid-range sound output; tweeter 20 producing sound in the upper range of octaves; and tweeter control knob 20A controlling the tweeter sound output; left speaker wire connector 28A connects the multi-dimensional speaker 10 to an amplifier; and right speaker connector 28B connects the multi-dimensional speaker 10 to an amplifier.

Figure 10:
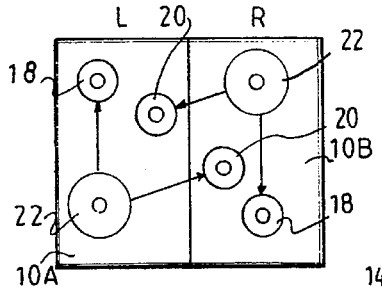
FIG. 10 is a side view of a multi-dimensional speaker system having wire cross overs.

Now referring to FIG. 10 which is a side view of a 2-way multi-dimensional speaker system having wire crossovers exhibiting the following features: a first mid-range 18 producing sound in the middle range of octaves having a cross-over wiring to at least two tweeters 20 the first being positioned on the upper portion of a first side of a speaker cabinet and a second being positioned on a lower portion of a second side of a speaker cabinet and a second mid-range 18 producing sound in the middle range of octaves having a cross-over wiring to at least two tweeters 20 being the second being positioned on the upper portion of a first side of a speaker cabinet and a second being positioned on a lower portion of a second side of a speaker cabinet.

Figure 11:
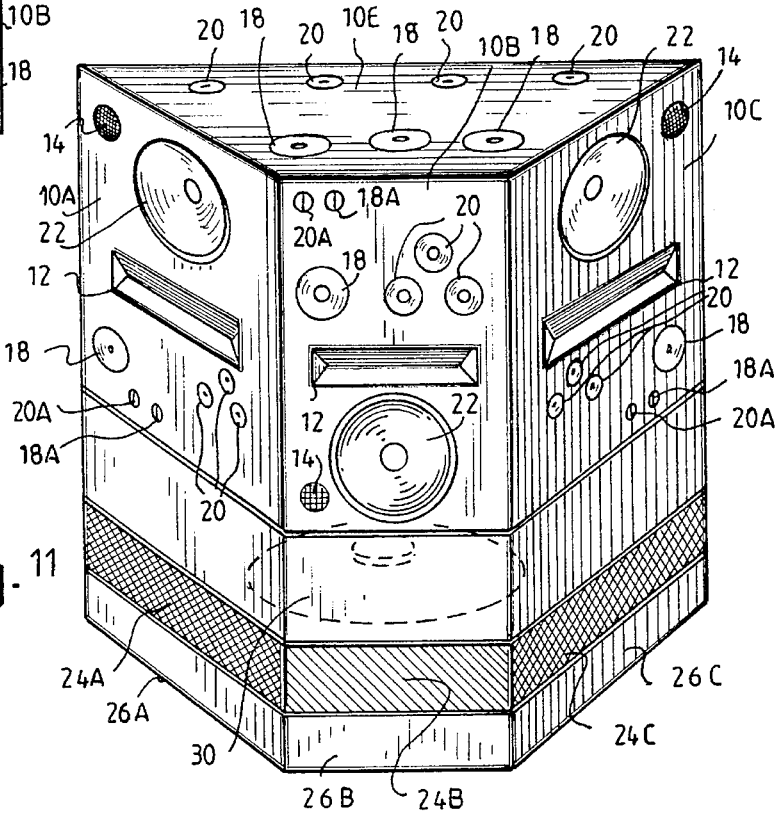
FIG. 11 is a perspective view of a multi-dimensional speaker system having numerous speakers and sound baffles.

Now referring to FIG. 11 which is a perspective view of a 3-way multi-dimensional speaker system having numerous speakers and sound baffles exhibiting the following features: multi-dimensional speaker system 10 having multiple sides containing numerous speakers, air baffles and speaker baffles; multi-dimensional speaker system first side 10A having an air baffle 14 positioned at the upper right hand corner, a mid-range 18 positioned at the middle left hand side, a mid-range control knob 18A, a plurality of tweeters 20 positioned at the upper left hand corner, a tweeter control knob 20A, a sub-woofer 22 positioned at the lower left side, a multi-dimensional speaker system first side speaker baffle 24A positioned at the bottom, and multi-dimensional speaker system first side spacer 26A; multi-dimensional speaker system second side 10B having an air baffle 14 positioned at the lower right hand corner, a mid-range 18 positioned at the middle right hand side, a mid-range control knob 18A, a plurality of tweeters 20 positioned at the lower left hand corner, a tweeter control knob 20A, a sub-woofer 22 positioned at the lower left side, a multi-dimensional speaker system second side speaker baffle 24B positioned at the bottom, and multi-dimensional speaker system second side spacer 26B; multi-dimensional speaker system top side 10E having a plurality of mid-range speakers 18 mounted diagonally opposite one another and a plurality of tweeters 20 mounted therebetween; mid-range horn 12 producing sound in the middle range of octaves; air port 14 allowing sound produced within the speaker cabinet to resonate outwardly; mid-range 18 producing sound in the middle range of octaves; tweeter 20 producing sound in the upper range of octaves 22—sub-woofer 22 producing sound in the lower range of octaves; multi-dimensional speaker system speaker baffle 24 allowing sound produced within the speaker cabinet to resonate outwardly comprising a multi-dimensional speaker system first side speaker baffle 24A allowing sound produced within the speaker cabinet to resonate outwardly and a multi-dimensional speaker system second side speaker baffle 24B allowing sound produced within the speaker cabinet to resonate outwardly; and multi-dimensional speaker system spacer 26 providing a space whereby the multi-dimensional speaker system speaker baffle 24 is suspended away from the floor, thus, allowing increased and purer sound reproduction, comprising a multi-dimensional speaker system first side spacer 26A providing a space whereby the multi-dimensional speaker system first side speaker baffle 24A is suspended away from the floor, thus, allowing increased and purer sound reproduction and a multi-dimensional speaker system second side spacer 26B providing a space whereby the multi-dimensional speaker system second side speaker baffle 24B is suspended away from the floor, thus, allowing increased and purer sound reproduction; mid-range control knob 18A controlling the mid-range sound output; and tweeter control knob 20A controlling the tweeter sound output.

It will be understood that each of the elements described above, or two or more together, may also find a useful application in other types of constructions differing from the type described above.

While the invention has been illustrated and described as embodied in a speaker cabinet, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A multi-dimensional speaker system comprising:

a) a housing;

b) a plurality of speakers being at least one mid-range horn producing sound in a middle range of octaves, at least one mid-range producing sound in a middle range of octaves, at least one tweeter producing sound in an upper range of octaves, at least one sub-woofer producing sound in a lower range of octaves, at least one woofer producing sound in a lowest range of octaves;

c) at least one multi-dimensional speaker system speaker baffle allowing sound produced within said speaker cabinet to resonate outwardly; and d) a multi-dimensional speaker system spacer providing a space whereby said multi-dimensional speaker system speaker baffle is suspended away from a floor, thus, allowing increased and purer sound reproduction, said multi-dimensional speaker system having a multi-dimensional speaker system first side having an air baffle positioned at an upper right hand corner, a midrange positioned at a middle left hand side, a midrange control knob, a plurality of tweeters positioned at an upper left hand corner, a tweeter control knob, a sub-woofer positioned at a lower left side, a multi-dimensional speaker system first side speaker baffle positioned at the bottom, and multi-dimensional speaker system first side spacer positioned beneath said multi-dimensional speaker system baffle functioning to suspend said multi-dimensional speaker system baffle away from a floor, thus, allowing emanation of loader and purer sound production, a multi-dimensional speaker system second side having an air baffle positioned at a lower right hand corner, a midrange positioned at a middle right hand side, a midrange control knob, a plurality of tweeters positioned at a lower left hand corner, a tweeter control knob, a sub-woofer positioned at a lower left side, a multi-dimensional speaker system second side speaker baffle positioned at a bottom, and a multi-dimensional speaker system second side spacer positioned beneath said multi-dimensional speaker system baffle functioning to suspend said multi-dimensional speaker system baffle away from a floor, thus, allowing emanation of loader and purer sound production, a multi-dimensional speaker system third side having an air baffle positioned at an upper right hand corner, a midrange positioned at a middle left hand side, a midrange control knob, a plurality of tweeters positioned at an upper left hand corner, a tweeter control knob, a sub-woofer positioned at a lower left side, a multi-dimensional speaker system third side speaker baffle positioned at a bottom, and multi-dimensional speaker system third side spacer positioned beneath sd multi-dimensional speaker system baffle functioning to suspend said multi-dimensional speaker system baffle away from a floor, thus, allowing emanation of loader and purer sound production, a multi-dimensional speaker system fourth side having an air baffle positioned at a lower right hand corner, a mid-range positioned at middle right hand side, a mid-range control knob, a plurality of tweeters positioned at a lower left hand corner, a tweeter control knob, a sub-woofer positioned at a lower left side, a multi-dimensional speaker system fourth side speaker baffle positioned at a bottom, and multi-dimensional speaker system fourth side spacer.

2. A multi-dimensional speaker system as described in claim 1, whereas said multi-dimensional speaker system having a multi-dimensional speaker system top side having a plurality of midrange speakers mounted diagonally opposite one another and a plurality of tweeters mounted therebetween.

3. A multi-dimensional speaker system as described in claim 2, whereas said multi-dimensional speaker system having a plurality of multi-dimensional speaker system side covers covering and protecting said multi-dimensional speaker system sides and a multi-dimensional speaker system top side cover covering and protecting said multi-dimensional speakers contained therein.

4. A multi-dimensional speaker system as described in claim 3, whereas said multi-dimensional speaker system having a multi-dimensional speaker system sound radiator positioned between a floor and said multi-dimensional speaker system functioning to enhance radiation of sounds therefrom and being able to rotate omni directionally having swivels therebetween an upper and lower multi-dimensional speakers.

5. A multi-dimensional speaker system as described in claim 4, whereas said multi-dimensional speaker system having a multi-dimensional speaker system first upper side comprising a plurality of tweeters positioned at a bottom and a woofer positioned at a top, a multi-dimensional speaker system second upper side comprising a plurality of tweeters positioned at said top and a woofer positioned at said bottom, a multi-dimensional speaker system third upper side comprising a plurality of tweeters positioned at said bottom and a woofer positioned at said top, and a multi-dimensional speaker system forth upper side comprising a plurality of tweeters positioned at said top and a woofer positioned at said bottom.

6. A multi-dimensional speaker system as described in claim 5, whereas said multi-dimensional speaker system having a multi-dimensional speaker system first lower side comprising a plurality of tweeters positioned at a top and a woofer positioned at a bottom, a multi-dimensional speaker system first side speaker baffle positioned at said bottom, and a multi-dimensional speaker system first side spacer positioned at said bottom underneath said multi-dimensional speaker system first side speaker baffle, a multi-dimensional speaker system second lower side comprising a plurality of tweeters positioned at said bottom and a woofer positioned at the top, a multi-dimensional speaker system second side speaker baffle positioned at said bottom, and a multi-dimensional speaker system second side spacer positioned at said bottom underneath said multi-dimensional speaker system second side speaker baffle, a multi-dimensional speaker system third lower side comprising a plurality of tweeters positioned at said top and a woofer positioned at said bottom, a multi-dimensional speaker system third side speaker baffle positioned at said bottom, and a multi-dimensional speaker system third side spacer positioned at said bottom underneath said multi-dimensional speaker system third side speaker baffle, and a multi-dimensional speaker system forth lower side comprising a plurality of tweeters positioned at said bottom and a woofer positioned at said top, a multi-dimensional speaker system forth side speaker baffle positioned at said bottom, and a multi-dimensional speaker system forth side spacer positioned at said bottom underneath said multi-dimensional speaker system forth side speaker baffle.

* * * * *